OPEN-END SPINNING METHOD AND APPARATUS

This invention relates to an improved method of open-end spinning and to an apparatus for performing the same, said apparatus comprising a fiber separating device, a spinning device, a yarn take-off device, and a yarn winding mechanism.

There exist many various open-end spinning systems operating on different principles, but the best results have up to now been achieved by open-end rotor spinning systems.

A spinning unit of this type of system comprises, as a rule, a fiber separating device designed for converting a supplied fibrous sliver into a flow of discrete fibers, a spinning device having a spinning rotor as the main functional element thereof, a yarn take-off device, and a yarn winding mechanism.

The aforementioned flow of discrete fibers is conveyed, due to a subatmospheric pressure produced in the spinning rotor interior, through a fiber feeding duct onto a sliding wall of the spinning rotor on which the fibers follow spherical trajectories before they reach a collecting channel provided in the inner wall of the spinning rotor in the region of the maximum diameter thereof.

Due to the fact that fibers are supplied through a stationary feeding duct onto the sliding wall which revolves at a relatively high speed, they are deposited, more or less at random, onto said wall on which they advance up to the collecting channel where they form a fibrous ribbon.

The process of depositing fibers onto the sliding wall of the spinning rotor, which is called in professional literature "cyclic fiber doubling", very positively influences the uniformity of fibers supplied to the collecting channel.

When, at the beginning of spinning process, a yarn end is supplied to the fibrous ribbon formed in the collecting channel, through a yarn take-off duct provided in the axis of spinning rotor, said end begins to rotate, due to the rotation of the spinning rotor, and due to centrifugal force joins said fibrous ribbon at a point. Due to the withdrawal of yarn from the spinning rotor by the take-off device, the continuity of the fibrous ribbon is interrupted while the end of the broken ribbon is carried away by said yarn end. Each ribbon length which is withdrawn within the time of one revolution of the collecting channel about the spinning rotor axis is given one twist turn, whereby if there is a continuous fiber supply to the sliding wall, fresh yarn is permanently produced, is withdrawn by the take-off device, and is finally wound on a bobbin.

Although it is possible effectively to produce in this way yarns of very good parameters, the productivity of such a system—which depends upon the yarn take-off speed—is limited by the rotational speed of the spinning rotor. Further increase of the spinning rotor revolution rate is limited, on the one hand, by the technical possibilities available and, on the other hand, by the fact that the centrifugal force, to which the end of the yarn being formed is exposed, reaches such high values that the spinning process becomes impossible. Apart from the aforesaid fundamental limitations, high revolution rates of the spinning rotor raise the machine noisiness, reduce the lifetime of rotor bearings, and are responsible for a substantial increase of the power demand for driving the spinning unit.

Every increase of the revolution rate of spinning rotors requires the reduction of the diameter thereof; this, in turn measures the limits of the range of the manufactured products.

It is an object of the present invention to provide a qualitative improvement of the open-end spinning principle, and particularly insofar as the effect of the aforementioned cyclic fiber doubling in the spinning process and the productivity of the spinning unit are concerned. Apart from this, the invention brings about a simplification of the construction of the spinning device and enables a broad range of yarn product types to be manufactured in one and the same unit.

This and other objects are substantially attained by an open-end spinning method in which, according to the invention, a flow of discrete fibers is supplied to a fiber spreading element by which they are spread over the entire periphery of an inner fiber deposit surface of a drum on which a fibrous layer is continuously created, from which layer fibers are successively withdrawn by the open end of yarn being taken off, said end being caused to rotate about its axis due to a twisting moment acting on the yarn being created in a region beyond the drum axis.

It is preferable that the yarn being formed be given an additional twist by causing the open yarn end to revolve about the drum axis.

With regard to the yarn formation the following variants are available:

1. The fibrous layer follows a circular path while the position of the axially rotating yarn open end is constant.

2. The axially rotating yarn open end follows a circular path while the position of the fibrous layer is constant.

3. The fibrous layer follows a circular path while the axially rotating yarn open end revolves around a concentric circular path but in the opposite direction.

4. The fibrous layer follows a circular path while the axially rotating yarn open end revolves around a concentric circular path in the same direction but at a different peripheral velocity.

The yarn is formed from staple fibers which are withdrawn from the evenly doubled fibrous layer with the possibility of twisting them in two independent stages, viz, on the one hand, due to a torque action of the twisting means and, on the other hand, by imparting an additional twist, due to the revolution of said twisting means about the drum axis.

The invention also provides an apparatus for carrying out the above method. Such apparatus consists of a fiber separating device, a yarn take-off device, and a yarn winding mechanism. According to the invention the spinning device comprises a fiber spreading element toward the operating surface of which a fiber feeding duct of the fiber separating device is directed, a drum coaxial with said fiber spreading element, the drum being provided with an inner fiber deposit surface for receiving the spread fibers, yarn twisting means radially disposed relative to the axis of said drum, and finally a thread guide preceding the yarn take-off device, at least one member of the pair comprising the drum and the yarn twisting means being rotatable about the axis of the drum.

In one preferred embodiment, the yarn twisting means which is provided with separate driving means, comprises a take-off tube for withdrawing the twisted yarn from the maximum diameter region of the fiber deposit surface. The yarn twisting means is provided on a carrier disposed radially on a driving shaft coaxial with the drum, the direction of rotation of said shaft corresponding to the direction of torque of the yarn twisting means.

From the viewpoint of the spinning process, it is preferred that the deposit surface conically flares, beginning from the inlet portion of the drum. To enhance the adhesion of fibers supplied to the deposit surface, the latter is provided with ventilation holes.

The yarn twisting means can be constituted by any of known means suitable to the purposes of the invention, such as, especially, those for imparting genuine and false twist. Preferably, a pneumatic twisting chamber, a rotor of an electric motor or of a pneumatic motor may be employed.

In the driving shaft, or also in the carrier, means are provided for supplying driving fluid to the twisting means.

According to another preferred embodiment, the yarn twisting means is provided on the carrier rotatable on a stationary guide tube coaxial with the drum and located between said drum and the yarn take-off device, the mouth of said tube being formed by a thread guide. The fiber deposit surface of the drum is formed as a peripheral groove having ventilation holes, such groove merging in the direction toward the thread guide by a conically narrowing surface into a cylindrical surface associated in the contactless manner with the yarn take-off tube, and in the direction toward the fiber spreading element into a flared sliding surface followed by the operating surface of said spreading element, said surface being provided on an inner conical surface of said element.

Embodiments of the spinning device which operate on the well-known twist tube principle are also advantageous. In accordance with one embodiment of this type, the yarn twisting means consists of a twist tube adapted for rolling between two frictional surfaces of rotation which are concentric with the drum axis and at least one of which is rotatable. This embodiment has two variants: (1) the outer frictional surface is provided on the inner wall of the drum, and the inner frictional surface is provided on a wheel rotatable in said drum; and (2) the outer frictional surface of rotation is provided on the inner wall of a rotatable, positively driven ring.

The last-mentioned variant makes it possible to twist the yarn independently of the drum motion.

The twist tube between the frictional surface is prevented from axial displacement by a flange guided in a peripheral groove provided in the outer frictional surface.

The apparatus of the invention also allows the manufacture of ply yarn of two yarn ends simultaneously spun on one and the same spinning unit.

According to an embodiment designed for the above purpose there is provided an additional twisting means disposed opposite and symmetrically relative to the first one. According to another embodiment an additional twist tube is designed for rolling between the two frictional surfaces and disposed opposite the first twist tube.

In the spinning unit according to the invention it is also possible to manufacture a core yarn from a carrier yarn supplied through the bore of the driving shaft to the mouth of a thread guide wherein said carrier yarn is braided with a freshly made yarn or yarns. To improve the orientation of fibers on the deposit surface of the drum, an electrostatic field excited by known means may be used.

The merit of the invention resides especially in that it enables the attaining of a high degree of the cyclic fiber doubling in the spinning process, a high productivity at relative low peripheral velocity of the operating spinning device elements, and the possibility of manufacturing yarns of various parameters and characteristics in one and the same spinning unit.

In order that the present invention may be better understood and carried in practice, some of preferred embodiments thereof will be hereinafter described with reference to the accompanying schematic drawings which, however, are not intended to limit in any way the scope of the invention. In the drawings.

Figure 1:
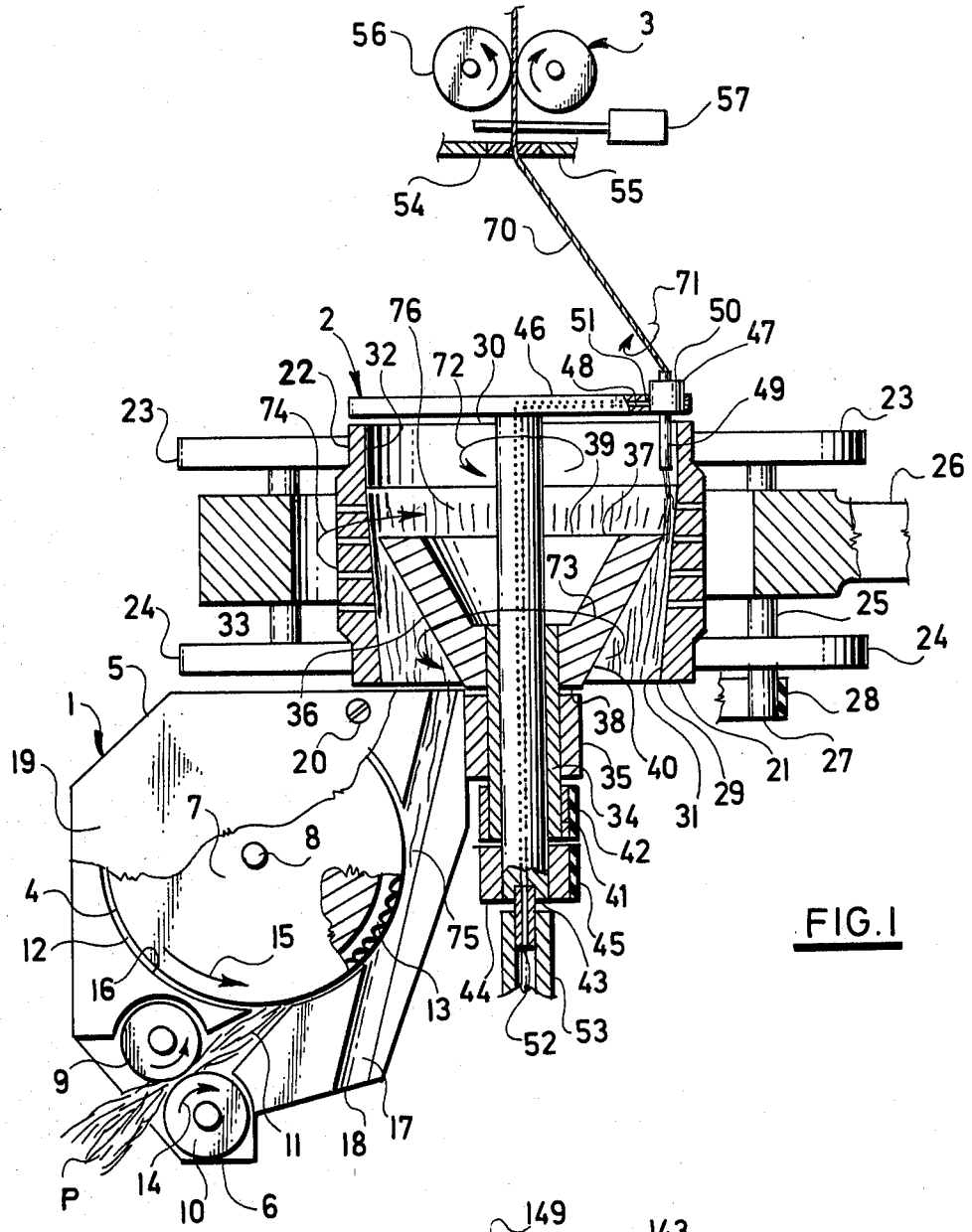
FIG. 1 is an axial sectional fragmentary view of a spinning unit according to the invention taken through the drum axis.

An open-end spinning unit comprises four functional modules, viz. a fiber separating device 1, a spinning device 2, a yarn take-off device 3, and a yarn winding device. Modules 1, 2 and 3 are shown in FIG. 1. The yarn winding device is not shown in such figure.

The fiber separating device 1 is received in a recess 4 provided in a housing 5; device 1 consists of a sliver feeding mechanism 6 and a combing cylinder 7 secured on a shaft 8.

The sliver feeding mechanism 6 which comprises a pair of feed rollers 9 and 10, is followed in the material flow direction by a sliver supply duct 11 provided also in the housing 5 and opening into a cavity 12. The combing cylinder 7, provided with card clothing 13, is received in cavity 12. The housing 5 is fixed to the frame (not shown) of the open-end spinning unit. The rotational movement of the positively driven feed roller 10 (see arrow 14) and that of the combing cylinder 7 (see arrow 15) are derived from driving means (not shown), the feed roller 9 being undriven.

The wall 16 of the cavity 12, which closely but contactlessly surrounds the periphery of the combing cylinder 7, intersects a straight fiber feeding duct 17 extending tangentially relative to the surface of the combing cylinder 7 and communicating with the ambient atmosphere by its inlet portion 18. The entire recess 4 is masked by a cover 19 preferably made of a transparent material and fixed to the housing 5 by bolts 20.

The spinning device 2 comprises a drum 21 which is mounted for rotation in such a manner that its two outer cylindrical surfaces 22 are engaged by a system of three or more pairs of support rolls 23, 24, each pair being interconnected by a shaft 25 rotatable in bearings (not shown) provided in the frame 26 of the open-end spinning unit, one of said roll pairs 23, 24 being positively driven while the other is undriven. An extension 27 of said shaft 25 is in engagement with a driving belt 28 running from the driving means (not shown) for the open-end spinning unit.

The drum 21 has an inlet portion 29 facing but not contacting said housing 5, and an outlet portion 30. The inner wall of the drum 21 flares out from its inlet portion 29 to its outlet portion 30 and forms a conical fiber deposit surface 31 which merges into a narrower cylindrical surface 32. In the central portion of the drum 21 there are provided ventilation holes 33 which due to the rotation of the drum 21 produce a subatmospheric pressure on said fiber deposit surface 31.

A shaft 34 coaxially extends into the drum 21; shaft 34 is mounted for rotation in a bearing (not shown) provided in a bracket 35 which is attached to the housing 5 by not shown means. On the end portion of the shaft 34 which protrudes into the interior of the drum 21 there is secured, e.g. by a not shown spring, a rotary fiber spreading element 36 in the form of a hollow frustrum of a cone 37 the minor base 38 of which is disposed at the inlet portion 29 of said drum 21 while the major open base 39 thereof extends into the region of said ventilation holes 33 in the deposit surface 31. The operating surface 40 of the spreading element 36 formed by its outer conical surface and surrounded by the fiber deposit surface 31 of the drum 21 faces the outlet port of the fiber feeding duct 17. At its opposite extremity, the shaft 34 carries a pulley 41 coupled via a driving belt 42 with the not shown driving means of the spinning unit.

In the shaft 34 there is rotatably mounted a driving shaft 43 the extremity of which projecting out of the pulley 41 carries a pulley 44 which is coupled via a driving belt 45 with the not shown driving means of the spinning unit. A carrier 46 of yarn twisting means 47 is radially arranged on the opposite end portion of the driving shaft 43 overlapping the cylindrical surface 32 of the drum 21. In the driving shaft 43 and said carrier 46 there is provided a drive fluid supply 48 for driving the yarn twisting means 47, means 47 having a fluid take-off tube 49 which enters the drum 21 and is disposed adjacent its cylindrical surface 32. The discharge opening of said tube 49 is located in proximity to the maximum inner diameter of the fiber deposit surface 31 of the drum 21.

In the exemplary embodiment shown, wherein the yarn twisting means 47 is pneumatic twisting chamber 50, the drive fluid supply 48 is embodied as a duct 51 extending axially through the carrier 46 and the driving shaft 43, and having its outer end portion coupled via labyrinth seal 52 to a pressure air supply tube 53 coming from a not shown source of superatmospheric air.

A thread guide 54 is arranged on the rotational axis of the drum 21 in a holder 55 fixed to the machine frame (not shown). Downstream of said thread guide 54 there is provided a yarn take-off device 3 comprising a pair of take-off rollers 56 followed by a yarn winding device (not shown).

Between the thread guide 54 and the take-off rollers 56 there is provided a thread breakage feeler 57 which is designed, on the one hand, for monitoring light signalling means and, on the other hand, an apparatus for the programmed control of the operation of individual working elements of the spinning unit.

For performing a spinningin step in the entire machine comprising a plurality of spinning units, the machine is provided with push-buttons for controlling the operation of working elements of the spinning unit, or with a programmed device for automatic spinning-in control. Such means are neither described nor shown since well-known devices are concerned.

Figure 2:
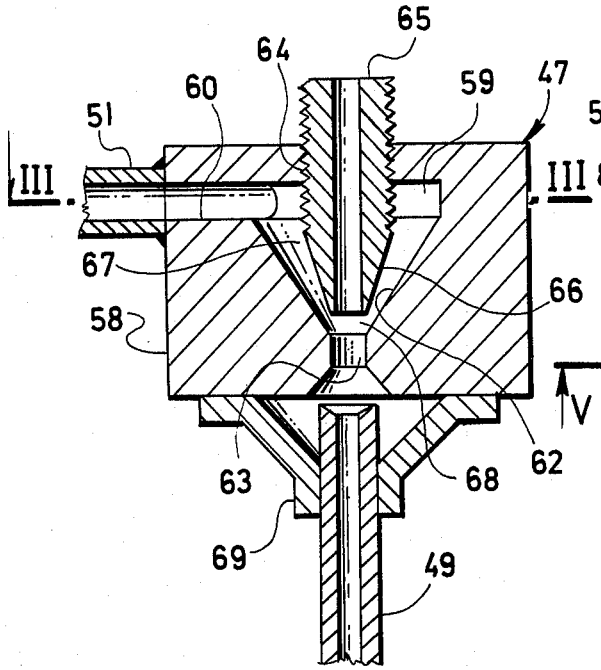
FIG. 2 is an axial sectional view of a yarn twisting means.
Figure 3:
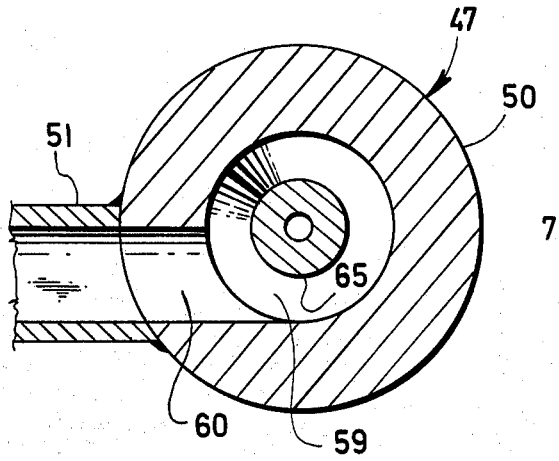
FIG. 3 is a cross-sectional view taken along line III—III in FIG. 2.

FIGS. 2 and 3 show respective sectional views of the pneumatic yarn twisting chamber 50 formed of a cylindrical body 58 having an inner cylindrical cavity 59 into which a duct 60 tagentially opens; the latter communicates with the duct 51 for supplying a drive fluid such as pressure air. The cylindrical cavity 59 merges into a conical cavity 62 narrowing into an outlet opening 63. An outlet tube 65 is screwed into an axial bore 64 of the cylindrical body 58. Between the conically narrowing end portion 66 of the outlet tube 65 and the wall of the conical cavity 62, an annular space 67 is provided which narrows into a spacing gap 68 situated between the mouth of the outlet opening 63 and the opening of the outlet tube 65. The inner diameter of the outlet opening 63 is larger than that of the outlet tube 65. The flared mouth of the outlet opening 63 faces the take-off tube 49 which is secured in a holder 69 fixed on the cylindrical body 58, and which also assumes the function of a damper of air flow passing therethrough. The space left between the mouth of the outlet opening 63 and the take-off tube 49 serves as an escape passage for air flowing out of the outlet opening 63 into the ambient atmosphere.

Pressure air supplied through the duct 60 into the cylindrical cavity 59 is formed into a helical vortex the effect of which acquires its maximum intensity in the spacing gap 68, such air escaping through the outlet opening 63 and the outlet tube 65 to the ambient atmosphere.

A yarn (not shown) passing through the take-off tube 49, the yarn twisting chamber 50, and the outlet tube 65 is twisted, in the region of the spacing gap 68, due to a torque of the air vortex, in the corresponding direction which is determined by the tangential position of the duct 60 relative to the axis of the cylindrical cavity 59. The axial component of the helical air vortex which acts against the yarn take-off, effectively increases the axial tension in the yarn.

The size of the annular space 67, the spacing gap 68, and consequently the intensity of the torque influencing the yarn can be adjusted by the axial positioning of the outlet tube 65.

The directions of rotation of yarn 70 in the pneumatic twisting chamber 50, of the driving shaft 43, of the fiber spreading element 36, and of the drum 21 are indicated by arrows 71, 72, 73 and 74, respectively. As apparent in FIG. 1, the fiber spreading element 36 and the drum 21 rotate in opposite directions.

The spinning unit as shown in FIG. 1 operates as follows:

A fibrous sliver P is withdrawn from a sliver reservoir (not shown) by the feed rollers 9 and 10 and is supplied through duct 11 to the combing cylinder 7. By the action of the card clothing 13 on cylinder 7, individual fibers 75 are combed out of a fiber bundle clamped along the nip line of said feed rollers 9, 10, and are accelerated to a speed corresponding to the peripheral velocity of the combing cylinder 7. In the region of the fiber feeding duct 17, the fibers are hurled off the cylinder surface by centrifugal force in a substantially tangential direction into said duct 17 and are entrained therethrough by air flow toward the operating surface 40 of the spreading element 36. On this surface, the fibers follow curvilinear paths and flow at last over the edge of said element 36 toward the deposit surface 31 of the drum 21 on which an evenly accumulated fibrous layer 76 is continuously formed due to a radial suction effect in the region of ventilation holes 33 and to a centrifugal force.

Due to the counterdirectional rotation and different peripheral velocities of the fiber spreading element 36 and the deposit surface 31, the fibers are thrown onto various regions of said deposit surface 31 whereby a cyclic formation of said uniform fibrous layer 76 on this surface occurs.

Fibers from the fibrous layer 76 are gradually wrapped up onto an open end of the yarn 70 twisted in the revolving pneumatic twisting chamber 50; the yarn 70 being formed is continuously withdrawn by the take-off rollers 56 via thread guide 54 and are finally cross-wound in the winding device (not shown).

The yarn is given a twist, on the one hand, by rotation about its own axis in the pneumatic twisting chamber 50 and, on the other hand, by the revolution of said chamber 50 in a circular path around the axis of the drum 21. However, the last mentioned motion is not obligatory for yarn production, but can be expediently availed of for producing yarn of a specific character. In the case in which the yarn is to be twisted due to torque only, the driving shaft 43 is made stationary so that only the drum 21 rotates.

Fibers are continuously taken off the revolving fibrous layer 76 by the positionally constant yarn open end, the fresh yarn being withdrawn along the axis of the drum 21 and wound on a bobbin.

In accordance with another embodiment, the yarn twisting chamber 50 can rotate about the axis of the stationary drum 21. In this case, fibers are gradually taken off the stationary fibrous layer 76 by the yarn open end revolving about the axis of the drum 21.

For the aforementioned alternative embodiments, the spinning unit is provided with means (not shown) for disengaging the drum 21 and the driving shaft 43, respectively, from the machine drive and for making them stationary.

Depending upon the desired characteristics of yarn, the direction of yarn rotation in the twisting device is chosen so that the fibers continuously taken off from the fibrous layer may be twisted either by wrapping down or wrapping up. The direction of torque of the yarn twisting means 47, the direction of rotation of this means 47 about the axis of the drum 21, and the direction of rotation of the drum 21 itself can be selected in dependence on the desired character of final yarn.

The spinning device operates at such rate as to produce a minimum thread breakage. A thread breakage is remedied as follows:

In case of yarn tension drop, or of a thread breakage, the feeler 57 switches off, via control means, the drives of the sliver feeding mechanism 6 of the fiber separating device 1, the fiber spreading element 36, the drum 21, the yarn twisting means 47 and the yarn take-off device 3, while only the combing cylinder 7 remains in operation. The yarn end unwound from the package mounted in the bobbin holder, which is now tilted off the driving roll, is introduced by the operator by means of a hook inserted into the spacing gap 68 from which it is sucked in through the outlet opening 63 and the take-off tube 49. The operator holds the yarn end at the inlet portion 29 of the drum 21, and by slightly drawing at said end raises the tension in the yarn so that the feeler 57 is set in operation and starts a program for switching on the individual working elements of the spinning unit. First, the drum 21, the sliver feeding mechanism 6, and the fiber spreading element 36 are started, and then, after reaching their respective operation speeds, there are simultaneously started the yarn take-off mechanism 3, the yarn twisting means 47 and the carrier 46 thereof; to whereupon a not shown mechanism tilts the bobbin holder down so that the package comes into engagement with the driving roll. After the start of the yarn take-off device 3, yarn slips off the operator's hand and the normal spinning process is restored. When the yarn end is introduced into the twisting means 47, the direction of torque has to correspond to the twist direction of the introduced yarn.

For an individual spinning-in step, but especially for simultaneous spinning-in steps, it is possible to employ suitable yarn grippers which are usual with similar spinning devices. When simultaneously spinning-in a plurality of spinning units of a spinning machine, the combing cylinders are first started and then the program of successively starting individual working elements of the spinning units is initiated.

Figure 4:
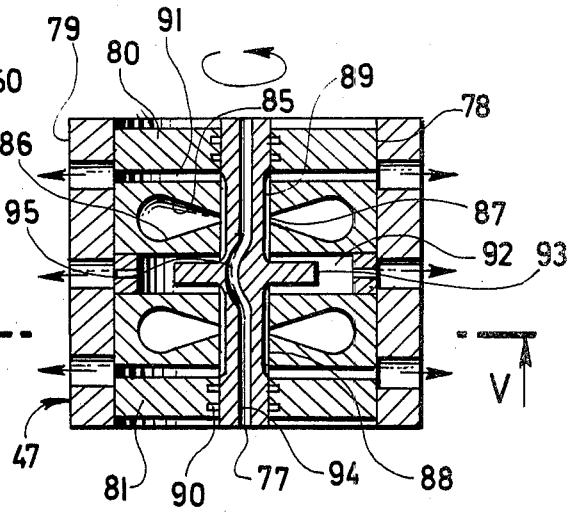
FIG. 4 is an axial sectional view of another embodiment of yarn twisting means.
Figure 5:
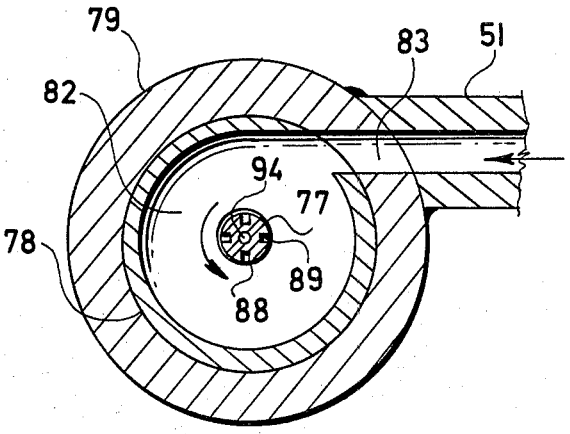
FIG. 5 is a cross-sectional view taken along line V—V in FIG. 4.

FIGS. 4 and 5 show respective sectional views of the yarn twisting means 47 embodied as a rotor 77 of a pneumatic motor 78. The rotor 77 is received in a cylindrical casing 79 and its end portions are supported in bearings provided in respective opposite side walls 80 and 81. Between said side walls 80 and 81 there are provided two annular chambers 82 into which ducts 83 tangentially open, such ducts 83 communicating via duct 51 with a pressure air source. Lateral walls 85, 86 of the chambers 82 converge from the widest peripheral portion thereof to a radial outlet hole 87 opening into a cavity 88 receiving the rotor 77. In the region of the outlet holes 87 the surface of the rotor is provided with longitudinal grooves 89 forming vanes therebetween.

The cavity 88 is axially confined at its extremities by side walls 80, 81 and by means of a labyrinth seal 90 communicates with the ambient atmosphere, on the one hand, via radial ducts 91 provided between one of the side walls and the adjacent annular chamber 82 and, on the other hand, via a radial duct 92 between said annular chambers 82. A radial shoulder 93 of the rotor 77 enters the radial duct 92.

The rotor 77 is further provided with an axial bore 94 which is provided with at least one bend 95, which is radial to the axis of the rotor 77; bend 95 imparts a torque to the yarn passing through the rotor 77.

The pressurized fluid supplied into the chamber 82 produces an excited potential vortex therein which imparts a high speed to the rotor 77. The yarn (not shown) passing through the rotor 77 is effectively twisted due to its passage through the radial bend 95 of the axial bore 94. Air escapes from the chamber 82 through a radial duct 92 past the radial shoulder 93 of the rotor 77; such escaping air secures the axial position of the rotor against the drag of the yarn passing through bore 94.

Figure 6:
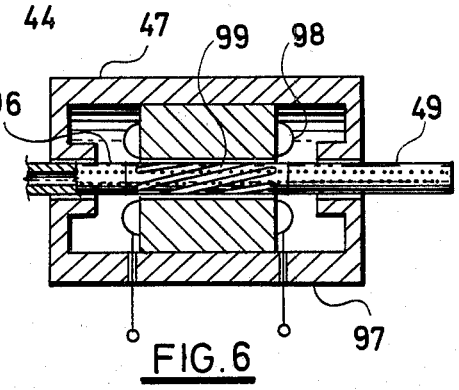
FIG. 6 is an axial sectional view of still another embodiment of yarn twisting means.

An alternative embodiment of the yarn twisting means 47 is illustrated in FIG. 6. It is constituted by a hollow rotor 96 of a squirrel-cage electric motor 97. Its stator 98 is fed, by way of example, with high-frequency two-phase current which can be supplied via a cable (not shown) disposed in drive fluid supply passage 48 provided in the carrier 46 (FIG. 1). The rotor 96 is embodied as an armature provided with a cage 99 formed by copper plating the armature by using a known electroplating technique. Since the conductors of the cage 99 preferably extend oblique to the axis of rotation of the rotor 96, the electric motor is given a uniform and constant torque. The transfer of the torque on to the yarn (not shown) passing through the bore of the rotor 96 can be cared for by various known mounting means such as thrust springs, grooves, protuberances, or the like.

The take-off tube 49 extends coaxially with the hollow rotor 96, for instance, as an extension thereof.

Figure 7:
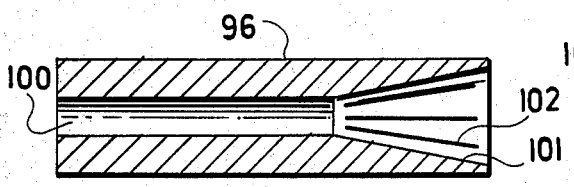
FIG. 7 is an axial sectional view showing a variant of the rotor of an electric motor used as a yarn twisting means and having carrying means.

The rotor 96 shown in FIG. 7 in a partial axial view is provided at one extremity of its axial bore 100 with a conical flaring-out 101 having longitudinal carrying grooves 102.

Figure 8:
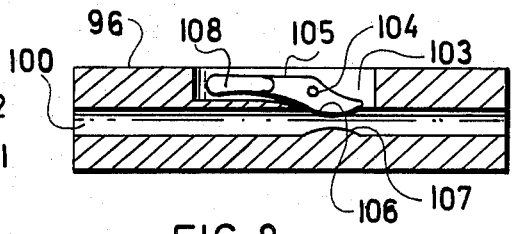
FIG. 8 is an axial sectional view showing another variant of the aforementioned rotor with carrying means.
Figure 10:
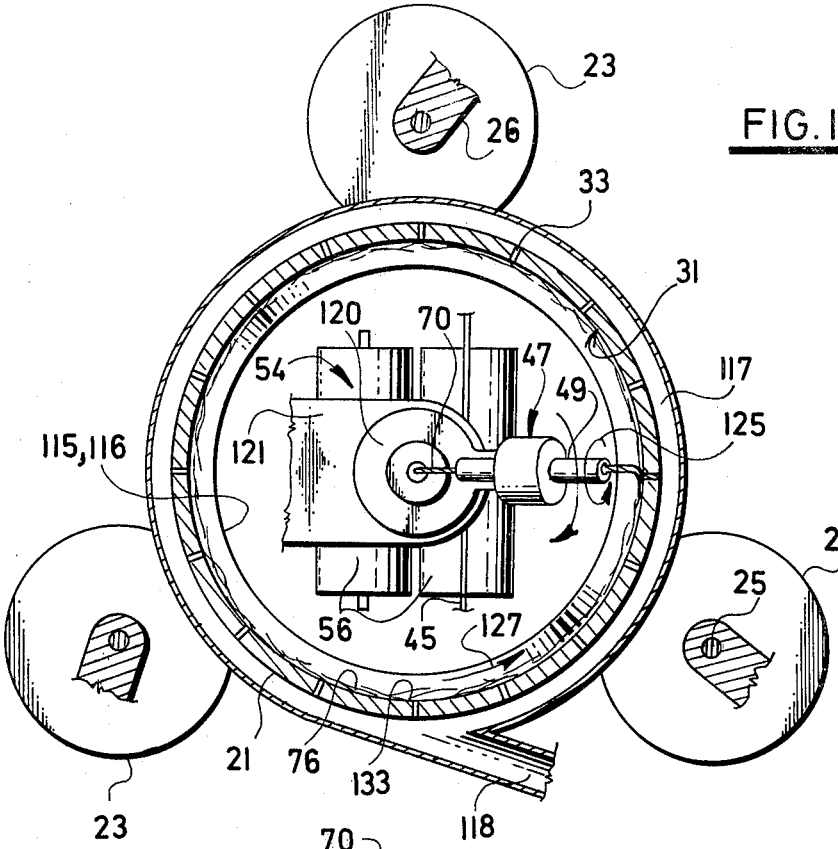
Figure 9:
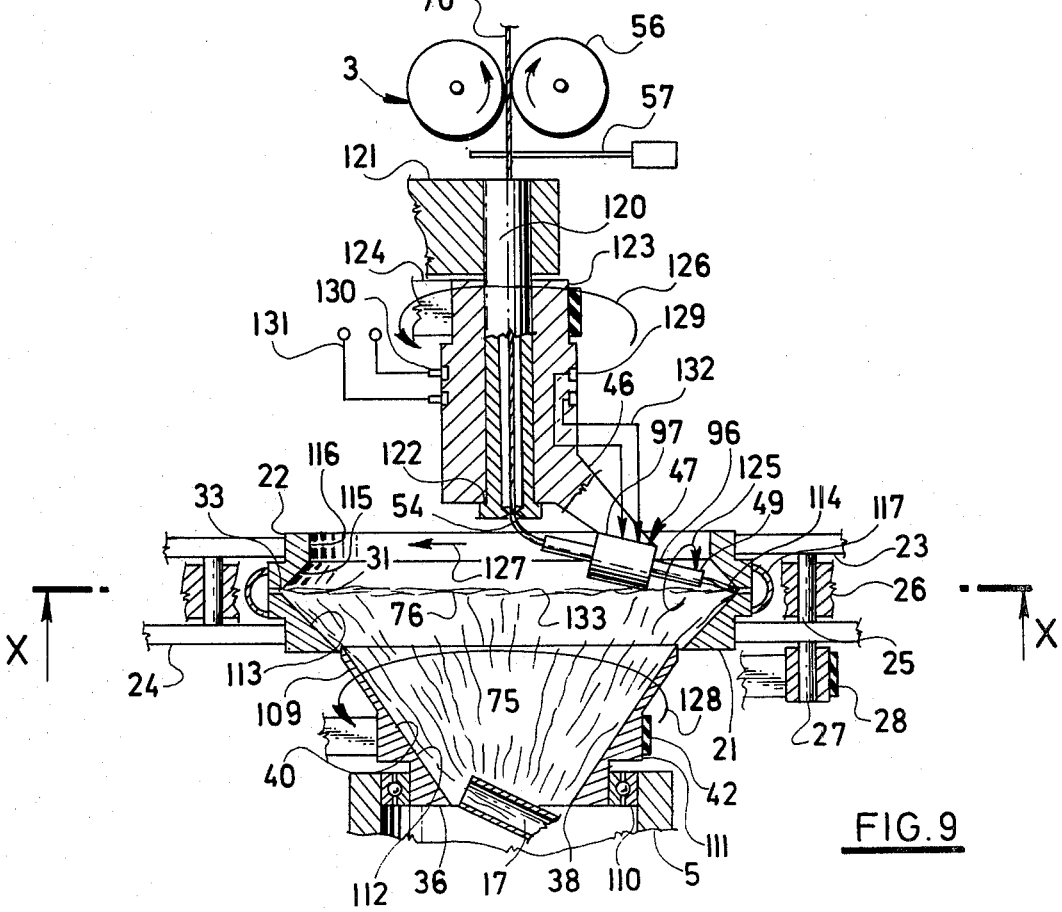

According to an alternative embodiment (FIG. 8), there is arranged in a recess 103 provided in the wall of the rotor 96 a two-armed lever 105 journalled about a pivot 104. A lighter arm of the lever 105, which is shaped as a finger 106, enters the axial bore 100 of the rotor 96 opposite a projection 107 provided on the wall of said bore 100, while the second, heavier arm 108 is received in said recess 103.

Due to the action of centrifugal force resulting from the rotation of the rotor 96, the finger 106 enters the axial bore 100 and grips the yarn passing therethrough, whereby the torque of the rotor 96 is transferred to the yarn.

Figure 10:
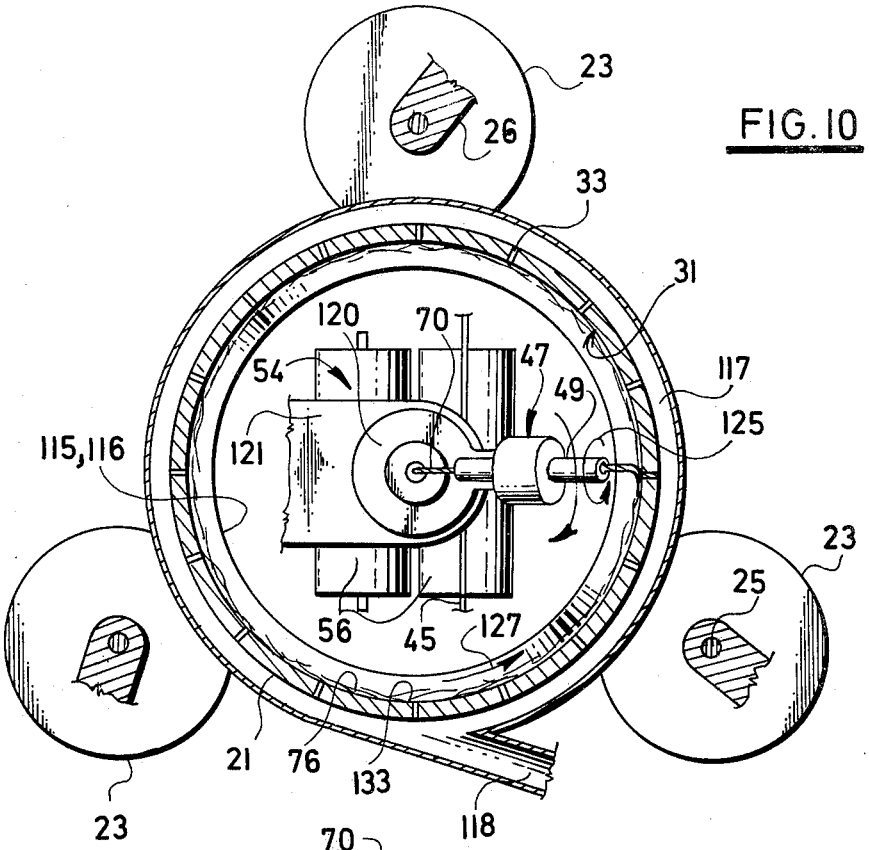
FIG. 10 is a cross sectional view taken along line X—X in FIG. 9.
Figure 9:
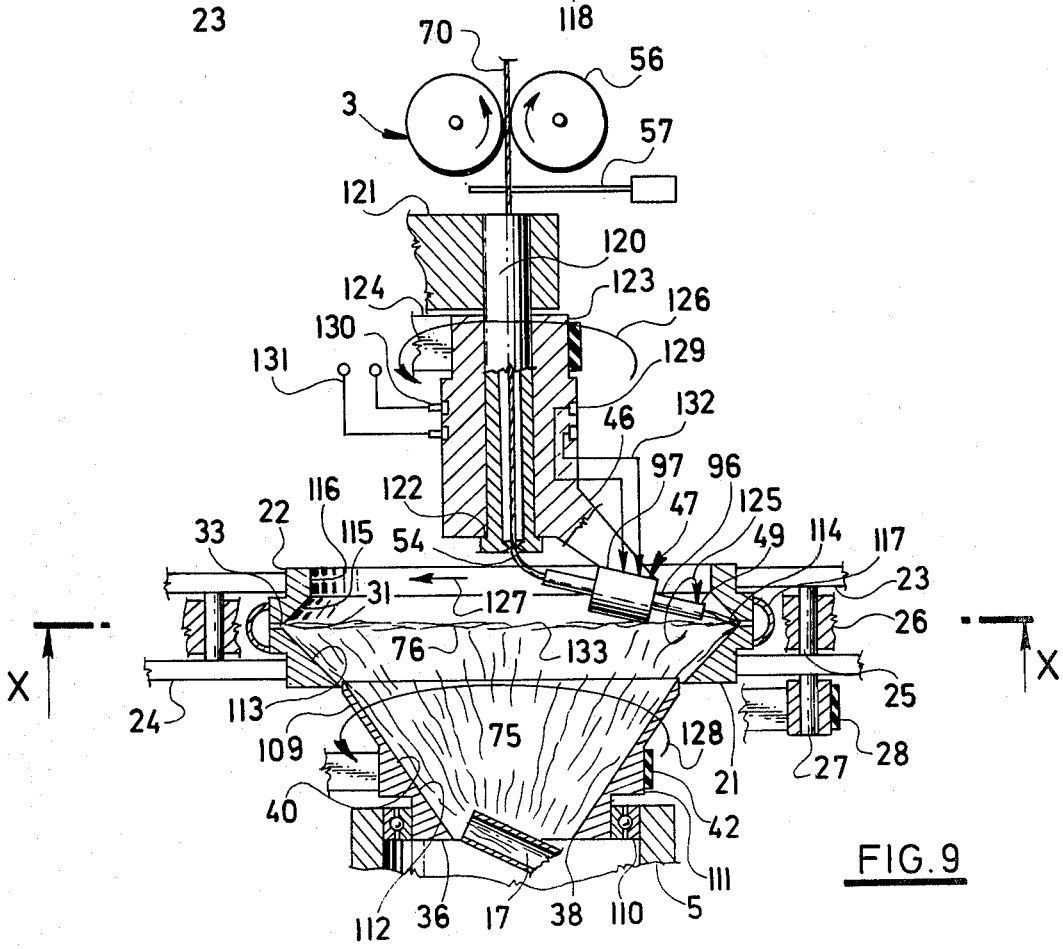
FIG. 9 is a fragmentary axial sectional view of another embodiment of the spinning unit, the section being taken through the drum axis.

Another alternative embodiment of the spinning unit according to the invention is illustrated in FIGS. 9 and 10. In this case, the fiber spreading element 36 is made as a hollow conical body 109, one part of which adjacent the minor base 38 thereof is mounted for rotation in bearings 110 provided in the partially shown housing 5 of the fiber separating device (not shown). A pulley 111 is provided on the conical body 109, such pulley being coupled via a belt 42 with the not shown driving means of the spinning unit. The operating surface 40 of the fiber spreading element 36 is embodied as an inner conical surface 112 facing the mouth of the feeding duct 17 of the fiber separating device; duct 17 enters the cavity of the spreading element 36 via the minor base of the hollow frustroconical body 109. The fiber spreading element 36 is immediately followed by the drum 21 the drive of which is accomplished in the same way as that of the drum 21 shown in FIG. 1. The operating surface 40 of the fiber spreading element 36 merges into a flaring-out slide surface 113 which in turn merges into the fiber deposit surface 31 shaped as a peripheral groove 114 provided with ventilation holes 33. The peripheral groove 114 merges into a conically narrowing surface 115 which merges into a cylindrical surface 116.

To raise the intensity of the operating subatmospheric pressure on the fiber deposit surface 31 of the drum 21, the ventilation holes 33 are enclosed from outside by an annular housing 117 communicating via duct 118 with a subatmospheric pressure source (not shown).

The yarn twisting means 47 embodied, by way of example, as a rotor 96 of an electric motor 97, is fixed to the carrier 46 forming a part of a hub 119 which is rotatable about a guide tube 120 which latter is coaxial to the drum 21 and is secured to the frame 121 of the spinning unit between said drum 21 and the yarn take-off device 3. The function of the take-off tube 49 is assumed in this case by one end of the rotor 96. The hub 119, the axial position of which relative to the guide tube 120 is ensured by means of a shoulder 122, is shaped at its opposite top end portion as a pulley 123 coupled via a belt 124 with the not shown driving means of the spinning unit. The mouth of the guide tube 120 is made as the thread guide 54. The thread breakage feeler 57 is disposed between the top opening of the guide tube 120 and the yarn take-off device 3.

The not shown axis of the take-off tube 49 is directed toward the peripheral groove 114. The directions of rotation of the yarn 70 in the yarn twisting means 47, of the carrier 46, of the drum 21, and of the fiber spreading element 36 are indicated by the respective arrows 125, 126, 127 and 128.

FIG. 9 also shows an examplary embodiment of power supply to the electric motor 97. The hub 119 carries collector rings 129 which are insulated relative to said hub and engageable by brushes 130 connected via lines 131 to a voltage source of electric current (not shown). The collector rings 129 are connected via lines 132 with the electric motor 97.

The embodiment of spinning unit shown in FIGS. 9 and 10 operates as follows:

Separated fibers conveyed through the fiber feeding duct 17 are thrown against the operating surface 40 of the fiber spreading element 36 from which they are thrown by the action of centrifugal force over the edge of the latter and over the slide surface 113, which rotates in counterdirection relative to the spreading element 36, into the peripheral groove 114 wherein a fibrous layer 76 in the form of fibrous ribbon 133 is produced. On the open end of yarn 70 twisted in the twisting means 47 in the direction of the arrow 125, fibers from the fibrous ribbon 133 are successively wrapped up, the produced yarn 70 being withdrawn through the guide tube 120 by the take-off rollers 56.

The fiber deposit surface 31, which in this embodiment is a frustro-conical surface, can be alternatively made as a cylindrical surface. In this case, however, it is desirable to provide it with ventilation holes 33 for producing a subatmospheric pressure necessary to hold the fibrous layer 76 on said deposit surface 31 of the drum 21.

The operating surface 40 of the fiber spreading element 36, which in the exemplary embodiments is shaped as an outer, or inner frustro-conical surface of said element 36 and which flares out in the direction toward the fiber deposit surface 31 of the drum 21, can assume, alternatively, the form of another surface of rotation the generatrix of which can be a curve the distance of which from the axis of rotation increases in the direction to the fiber deposit surface 31.

The operating surface 40 of the fiber spreading element 36 can be smooth, or can be, for example, roughened, or provided with protuberances, notches, needle clothing, or the like, in order to attain the maximum fictional effect on the fiber to be spread.

Figure 11:
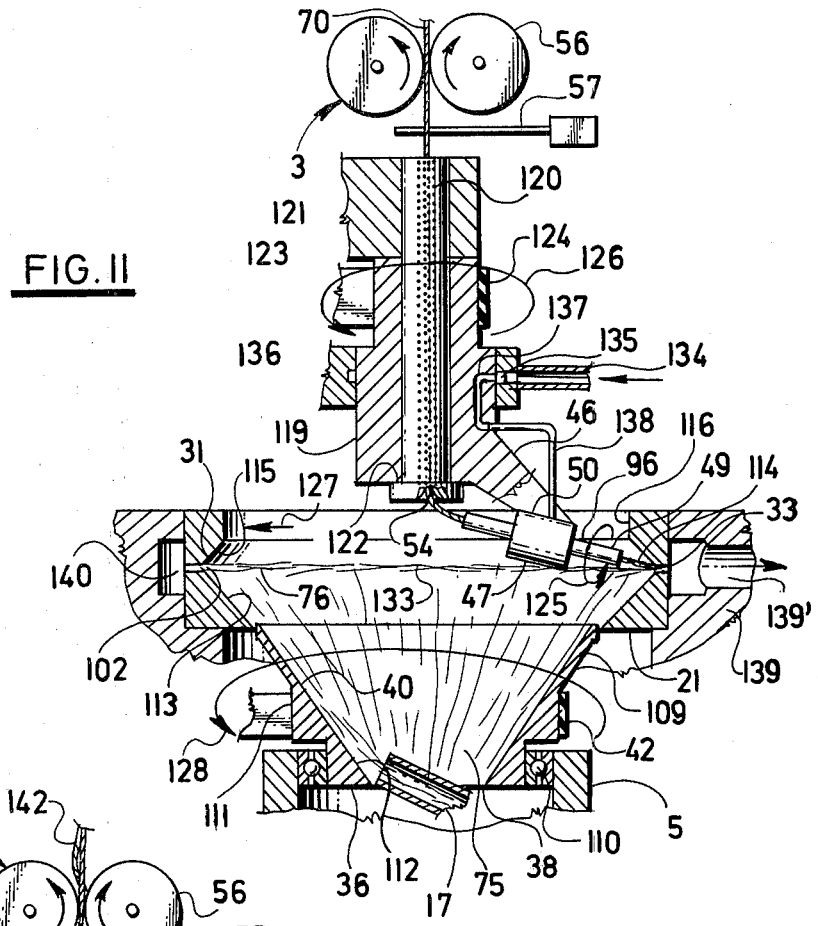
FIG. 11 is a fragmentary axial sectional view of still another embodiment of the spinning unit, the section being taken through the drum axis.

FIG. 11 shows an exemplary embodiment of the pressurized fluid supply into the yarn twisting chamber 50. Air under pressure is conveyed from a not shown source through a tube 134 to a peripheral channel 135 provided in the inner wall of a stationary collar 136 surrounding the hub 119. A duct 137 opens into said channel 135, said duct communicating via tube 138 with the yarn twisting chamber 50.

Unlike the embodiment shown in FIG. 9, the spinning device of FIG. 11 is provided with the stationary drum 21 supported in a holder 139 fixedly attached to the frame of the spinning unit. The ventilation holes 33 open into an annular recess 140 provided in the holder 139, which recess 140 communicates via duct 139' with a pressure source.

Fibers being accumulated in the peripheral groove 114 of the stationary drum 21 in the form of the fibrous ribbon 133 are successively wrapped up on the open end of yarn 70 twisted, due to a torque, in the direction of the arrow 125, in the twisting chamber 50. The produced yarn 70 is withdrawn through the guide tube 120 by means of the take-off rollers 56.

In accordance with the embodiment of FIG. 11, the yarn is given a twist produced by the torque of pressurized fluid acting on the yarn passing through the twisting chamber 50, and due to the rotation of said chamber about the axis of the drum 21. An advantage of this embodiment is that the spinning device comprises a small number of rotary elements, which results in a reduced power demand.

Figure 12:
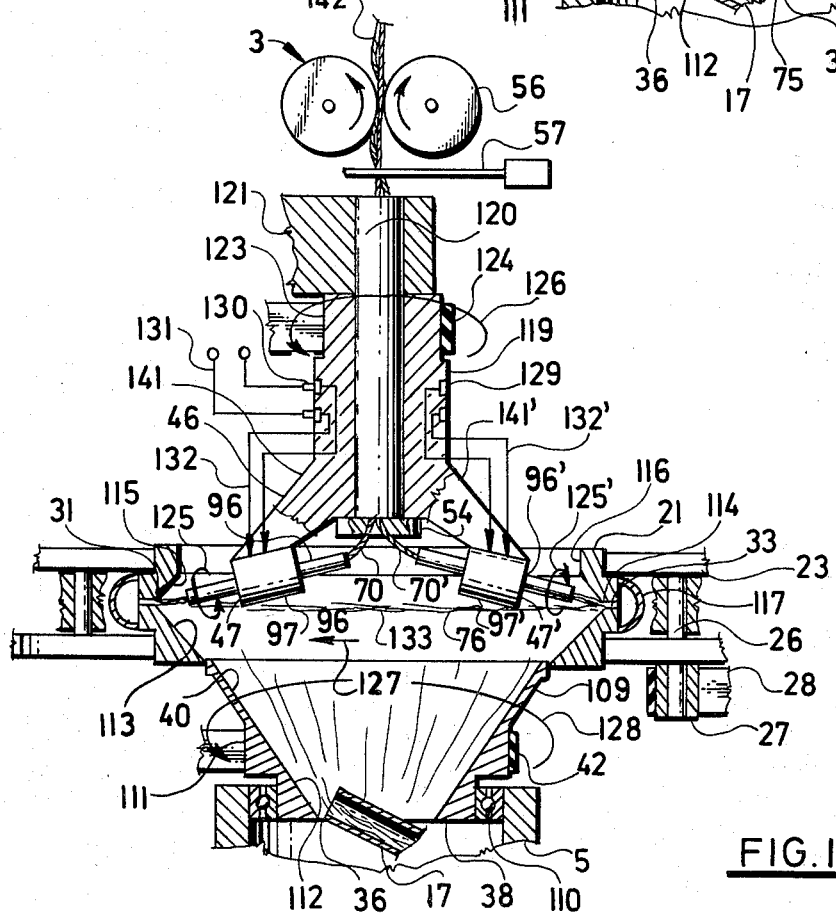
FIG. 12 is an axial sectional view of a spinning unit such as shown in FIG. 9 but equipped with two yarn twisting means.

FIG. 12 shows a spinning unit provided with two yarn twisting means 47, 47' constituted, by way of example, by electric motors 97, 97'. Reference numerals relating to such additional twisting means 47' and corresponding to the parts of the first twisting means 47 are provided with a prime. The carrier 46 is formed in this case by two arms 141, 141' provided symmetrically on the hub 119 which is driven by means of the belt 124. Collector rings 129 are connected with the electric motors 97, 97' by two separate electric supply lines 132, 132'.

Fibers withdrawn from the fibrous ribbon 133 produced in the peripheral groove 114 in the drum 21 which rotates in the direction of the arrow 127, wrap up gradually on two open yarn ends 70, 70' which are twisted, due to a torque in the twisting means 47, 47', in the directions of the respective arrows 125, 125'. Owing to the rotation of the carrier 46 in the direction of the arrow 126, the yarns are twisted in the thread guide 54 to form a ply yarn 142 which is withdrawn by the take-off rollers 56 and is wound on a bobbin in the winding device.

The twist of the ply yarn 142 corresponds to the direction of rotation of the carrier 46. Since the two yarn ends 70, 70' are to be produced from one and the same fibrous ribbon 133, the amount of the separated fibers supplied through the feeding duct 17 to the spinning device has to be increased accordingly.

However, it is also possible to provide two fiber separating devices the feeding ducts of which are arranged symmetrically at the inlet portion of the cavity of the fiber spreading element 36.

Figure 13:
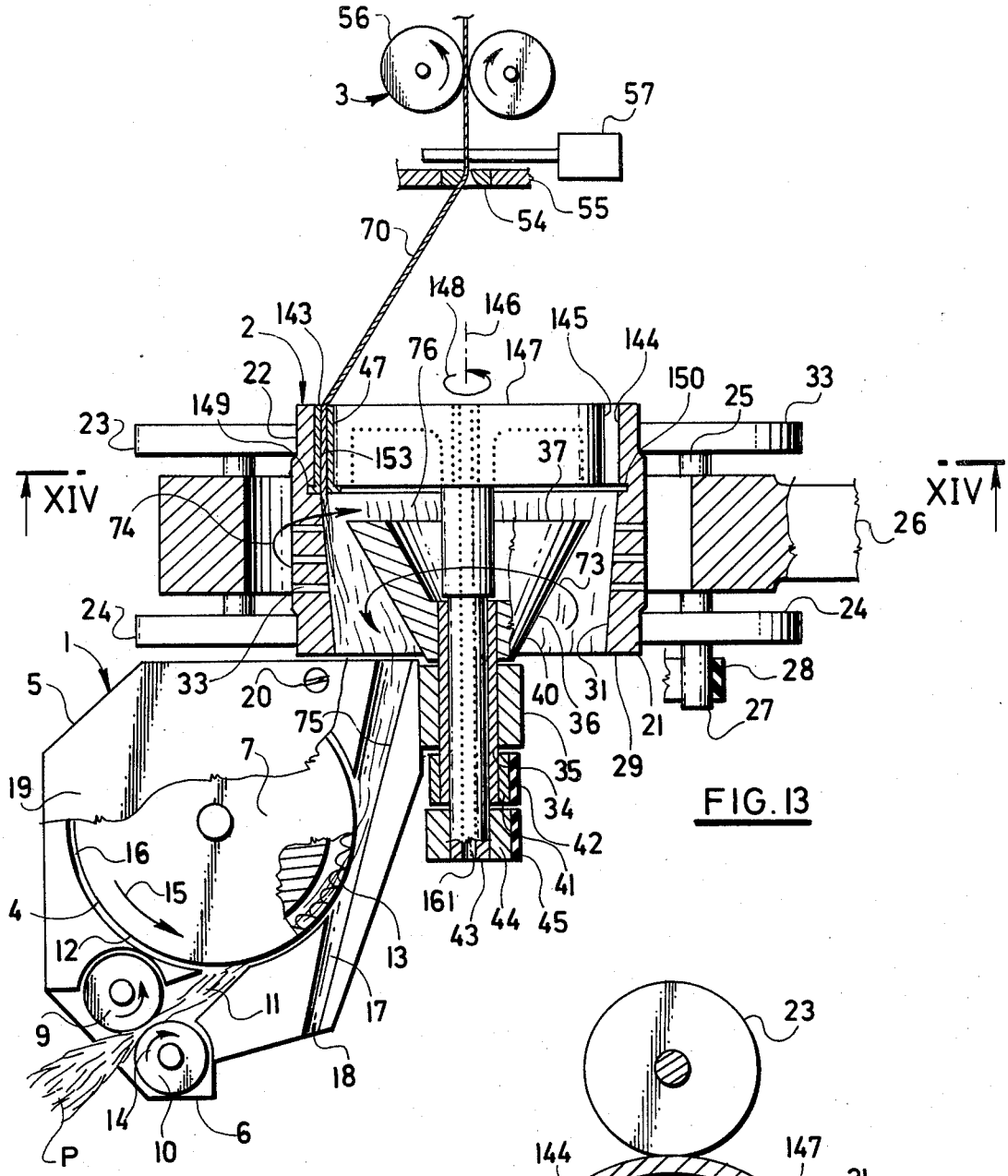
FIG. 13 is a fragmentary axial sectional view of still another embodiment of the spinning unit, the section being taken through the drum axis.

FIG. 13 shows a spinning unit the twisting means 47 of which is embodied as a twist tube 143 mounted for rolling between two frictional surfaces 144 and 145 coaxial with the axis 146 of the drum 21.

The frictional surface 144 is provided on the inner cylindrical wall of the drum 21, which wall merges at an angle into the fiber deposit surface 31 of the drum 21. The second frictional surface 145 is formed by the outer cylindrical wall of a wheel 147 secured, by not shown means, to the extremity of the driving shaft 43. The angle of inclination of the fiber deposit surface 31 relative to the axis of the twist tube 143 is to be chosen so that the open yarn end held by suction and centrifugal force against the deposit surface 31 may immediately point toward the bore 153 of the twist tube 143. The mounting and drive of the shaft 43, the manner of mounting and drive of the fiber spreading element 36, as well as that of the drum 21, correspond to those of the respective parts of the spinning unit shown in FIG. 1; thus the elements shown in FIG. 13 are indicated by the same reference numerals as those employed in FIG. 1. The direction of rotation of the drum 21, indicated by arrow 73, is opposite to that of the wheel 147, indicated by arrow 148.

In the embodiment of FIG. 13, both the frictional surface 144 and the fiber deposit surface 31 are provided on the drum 21. The direction of rotation of the fiber spreading element 36 (indicated by arrow 74) can either correspond to that of the drum 21 (indicated by arrow 73), or be opposite thereto. Between the frictional surfaces 144 and 145, the twist tube 143 is secured against axial displacement due to a yarn drag, by a flange 149 guided in a peripheral groove 150 which is provided in the outer frictional surface 144.

The twist tube 143 is caused to rotate about its axis, due to the mutual relative counterdirectional rotation of the two frictional surfaces 144, 145; it is to be understood that one of said surfaces can be stationary. When the two frictional surfaces rotate at the same peripheral speed, the twist tube 143 rotates about its axis while remaining in a constant position. In case of a difference in the peripheral speeds of said surfaces 144, 145, the twist tube 143 will revolve in the direction of the frictional surface rotating at a higher peripheral speed, its speed of revolution depending upon the ratio between the peripheral speeds of the two frictional surfaces.

Figure 14:
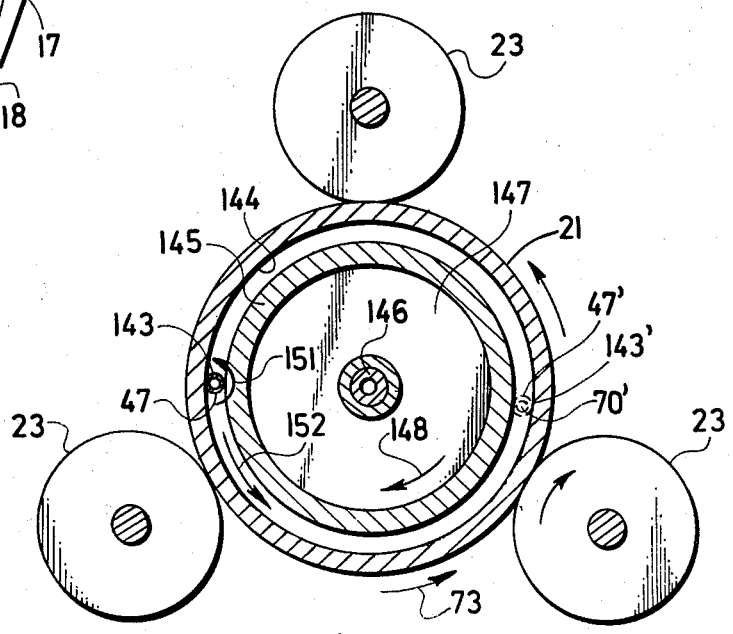
FIG. 14 is a cross-sectional view taken along line XIV—XIV in FIG. 13.

In the exemplary embodiment shown in FIGS. 13 and 14, which latter is a sectional view along the line XIV—XIV in FIG. 13, the twist tube 143 is rotatable about its axis in the direction of the arrow 151, and revolves simultaneously about the axis 146 of the drum 21 in the direction of the arrow 152.

It is an object of the twist tube 143, which is a well-known element of a work unit for the texturing of filament yarns by false twist, to impart one twist turn to the yarn passing through the twist tube during each revolution of the tube.

Figure 15:
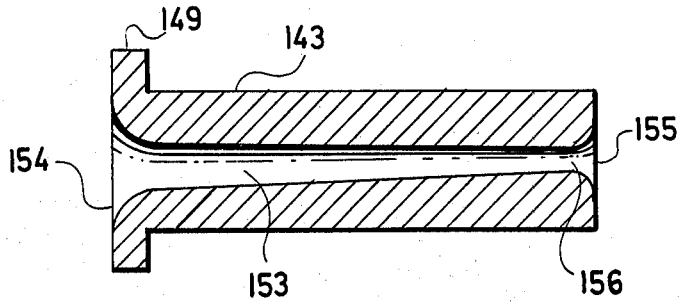
FIGS. 15 through 17 are axial sectional views of various embodiments of twist tubes.
Figure 16:
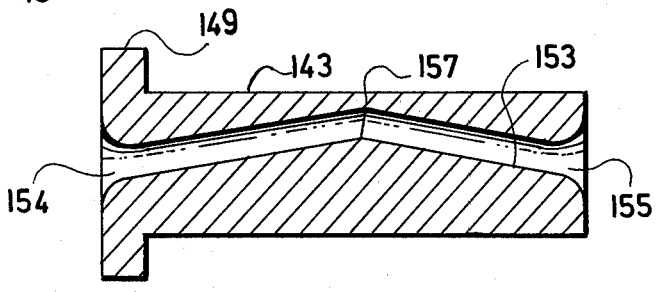
Figure 17:
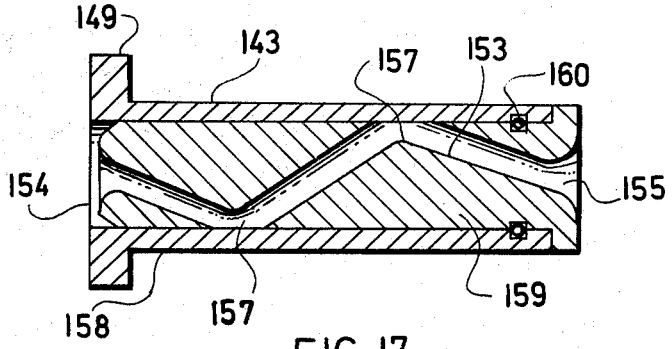

The frictional surfaces 144, 145 and the twist tube 143 are to be made at least at their operative portions, of materials having a high resistance to wear. Such twist tubes may be variously shaped, as shown in FIGS. 15, 16 and 17. Thus, for instance, FIG. 15 shows the twist tube 143 provided with the bore 153 narrowing in the direction of yarn movement. Both inlet and outlet portions 154 and 155 of the bore 153, respectively, are flared in a funnel-like manner. The narrowest neck 156 of the bore 153 is preferably smaller than the yarn diameter whereby the yarn is twisted, and is also positively pulled through the bore 153 by the centrifugal force operating upon it during the rotation of the twist tube 143.

Another embodiment of the twist tube 143 is shown in FIG. 16. Between its rounded inlet and outlet axial portions 154 and 155, respectively, the bore 153 is deflected from an axial course so that approximately in the middle of its length it reaches its maximum eccentricity 157. The centrifugal force acting during rotation of tube 143 on the bent yarn section effects the transfer of torque of the twist tube 143 onto the yarn passing through said bore 153.

According to another embodiment of the twist tube, which is shown in FIG. 17, the twist tube 143 consists of an outer jacket 158 receiving an inner cylindrical body 159 which is secured therein against axial displacement by a spring 160. In said cylindrical body 159 there is provided a bore 153 with two maximum eccentricity points 157. The inlet portion 154 and the outlet portion 155 of the bore 153 are also flared in a funnel-like manner. The two elements of the twist tube 143 are made of a material resistant to abrasion. Among the advantages of this embodiment are its easy manufacture and its reliability to transferring torque from the twist tube 143 onto the yarn even at relatively high take-off speeds.

On the axis 146 of the drum 21 there is provided the thread guide 54 which is followed by the thread breakage feeler 57, the take-off roller pair 56, and the yarn winding mechanism (not shown).

The spinning unit according to FIGS. 13 and 14 operates as follows:

As hereinabove described, the cyclically accumulated fibrous layer 76 is formed on the deposit surface 31 of the drum 21 from fibers spread by the spreading element 36. When a yarn end unwound from the bobbin supported in the holder is drawn, e.g. by means of a threading-in hook, into the region where the fibrous layer is formed, fibers from said layer 76 gradually wrap up onto said yarn end rotating in the direction of the arrow 151, whereupon, after the winding has been restored, the yarn withdrawn by the take-off rollers 56 is again wound to form a cross-wound package. During each revolution of the twist tube 143 about the axis of the drum 21, the yarn is given an additional twist turn in the direction of arrow 152 in the region of the thread guide 54.

The spinning unit shown in FIGS. 13 and 14 can be equipped with two yarn twisting means 47, 47', in a manner similar to that in the embodiment illustrated in FIG. 12.

The yarn twisting means 47, 47' are diametrically spaced apart in the gap between the frictional surfaces 144, 145 and are thus maintained during operation of the spinning device. The two yarns 70, 70' are twisted together in the region of the thread guide 54 to form a ply yarn which is withdrawn by the take-off rollers 56 and is wound on a bobbin by the winding mechanism. The twist direction of the twist yarn corresponds to the direction of arrow 152 (FIG. 14).

The spinning unit shown in FIG. 13 is also suitable for manufacturing a core spun yarn by braiding a carrier thread fed from a not shown supply package through a bore 161 in the driving shaft 43 to the thread guide 54 where said carrier thread is braided with plain or ply yarn. The spinning-in step after a possible thread breakage maybe effected in an alternative way relative to the thread breakage remedying step in the spinning unit shown in FIG. 1. In case of a critical yarn tension drop, the feeler 57 causes the switch-off, e.g. by means of electromagnetic clutches (now shown), of the sliver feeding mechanism 6, the fiber spreading element 36, the drum 21, the driving shaft 43, and the yarn take-off device 3. Only the combing cylinder 7 remains in operation. The operator introduces the yarn end unwound from the bobbin in the tilted-off holder, by means of a threading-in hook, through the bore 153 of the twist tube 143 and through the cavity of the drum 21 up to the edge of the inlet portion 29 of the drum 21. After the yarn introduction, the operator connects again by a pushbutton control the work elements of spinning unit to the drive, except for the yarn take-off device 3 and the sliver feeding mechanism 6. The bobbin holder with the bobbin in, rests in the tilt-off position.

During the rotation of the frictional surfaces 144, 145, the twist tube 143 also moves while the yarn end is held against the deposit surface 31, due to a subatmospheric pressure of technological air produced by the ventilation holes 33, in coaction with centrifugal force. Owing to this rotation and to the revolution of the twist tube 143 about the axis 146 of the drum 21, the number of twist turns in the yarn increases, particularly in the section thereof between its open end and the take-off device 3. At the same time, the tension in the yarn rises, whereby the feeler 57 is set in operation. Consequently, the electromagnetic clutch of the sliver feeding mechanism 6 and, after a predetermined delay, the electromagnetic clutch of the yarn take-off device 3, are engaged. Simultaneously, the bobbin holder is tilted, either by mechanical means or manually, down into its operative position in which the package is in frictional contact with the driving roll.

It results from the foregoing that after the feeler 57 has been set in operation, at first the fibrous layer 76 begins to be formed, whereupon the yarn produced of fibers successively wrapped up from the fibrous layer onto the yarn end is taken off.

Similarly in the simultaneous spinning-in process on the starting of the machine, the yarn ends are first introduced into the bores 153 of the twist tubes 143 either manually or by simple means such as, for example, sucking-in tubes (not shown). Also the bobbin holders are previously tilted off into inoperative positions. After these preparatory steps, the combing cylinders 7 are set in operation just at the beginning of the spinning, whereupon the time sequence of starting the work elements with all the spinning units of the machine is practically the same as hereinabove described.

Figure 18:
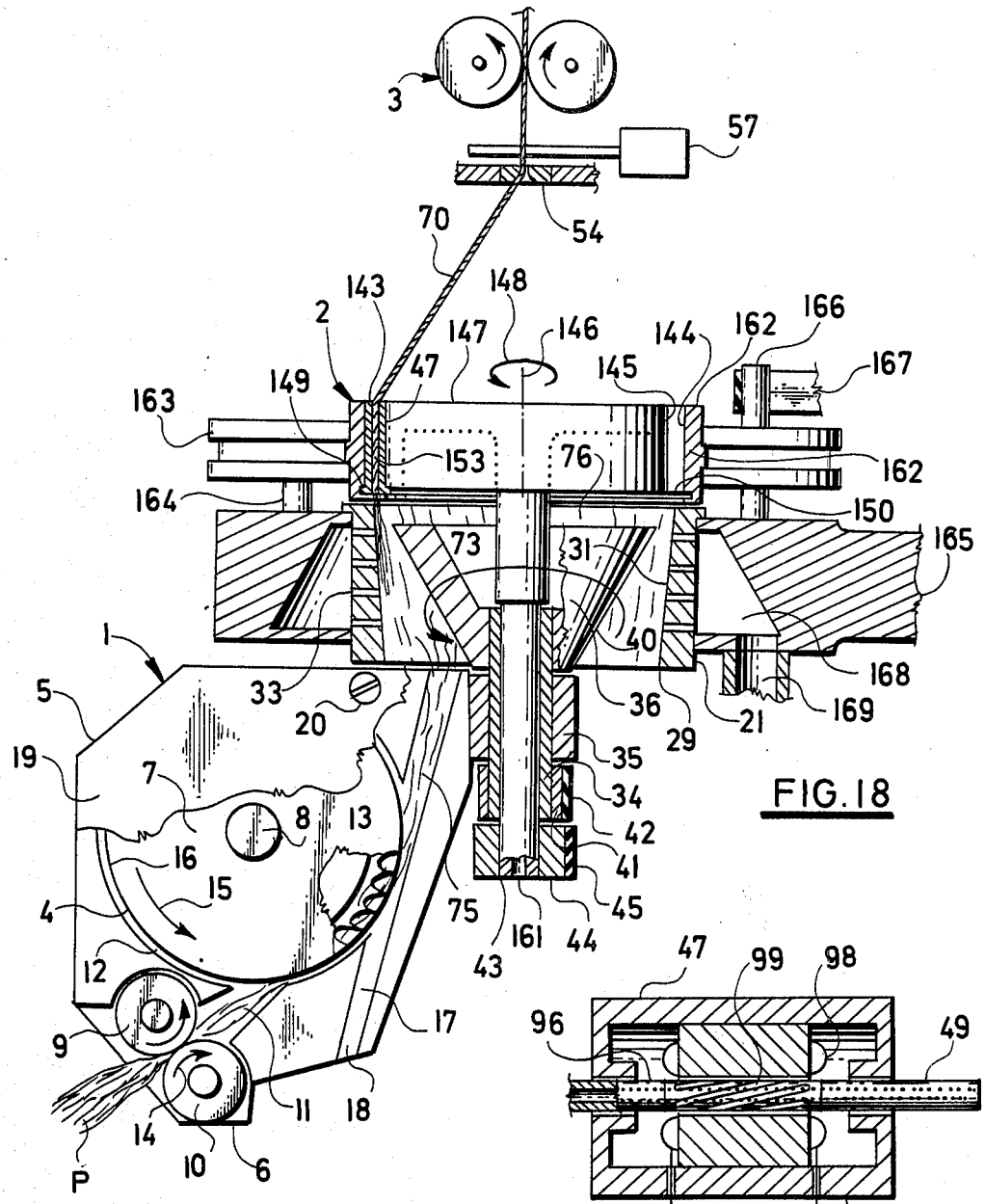
FIGS. 18, 19, 20 are fragmentary vertical sectional views of other variants of spinning units according to the invention, the sections being taken through the drum axis.

FIG. 18 shows an embodiment of the spinning unit wherein the outer frictional surface 144 is provided on the inner wall of a ring 162 mounted for rotation between three support rolls 163 the respective shafts 164 of which are rotatble in now shown bearings provided in an annular body 165 fixed to the machine frame (not shown). An extension 166 of the shaft 164 is coupled via belt 167 with the not shown driving means of the spinning unit.

The ring 162 is disposed at close proximity to but out of contact with the drum 21 which, unlike the embodiment illustrated in FIG. 13, is stationary in the annular body 165 and which is provided with the fiber deposit surface 31 with ventilation holes 33 which open into an annular duct 168. Said duct 168 provided in the annular body 165 communicates via duct 169 with a subatmospheric pressure source (not shown).

In a manner similar to that in the embodiment shown in FIG. 13 in FIG. 18 the inclination or conicity of the fiber deposit surface 31 relative to the axis of the twist tube 143 is chosen so as to make the open yarn end of the deposit surface 31 point directly toward the bore 153 of said tube 143. The twist tube 143 is also secured against axial displacement by its flange 149 engaged in the peripheral groove 150 in the wheel 147.

The arrangement and drive of the wheel 147 and of the fiber spreading element 36 correspond to those employed with the spinning unit shown in FIG. 13. The directions of rotation of the wheel 147 and the element 36 are indicated by respective arrows 148 and 73.

In the operation of the spinning unit of FIG. 18, the twist tube 143 rolls on counterdirectionally rotating frictional surfaces 144, 145 whereby it is given a rotational movement corresponding to that of the frictional surface 144, and simultaneously is given a revolutional movement about the axis 146 of the drum 21, due to a difference in peripheral speeds of said surfaces 144, 145. As hereinabove mentioned, the direction of rotation of said twist tube 143 will correspond to that of the frictional surface moving at a higher peripheral speed.

Fiber 75, spread by the element 36 simultaneously about the entire circumference of the stationary deposit surface 31, produce on the latter, under the assistance of the suction effect and centrifugal force, the fibrous layer 76 which is characterized by a lower degree of doubling when compared with the layer 76 formed on the moving deposit surface 31 in FIG. 13.

Onto rotating open yarn end which is twisted due to the passage through the twist tube 143, fibers taken from the fibrous layer 76 progressively wrap up; the thus arising yarn 70 withdrawn from the twist tube 143 by the take-off device 3 is wound in the not shown winding mechanism to form a cross-wound package.

An advantage of the embodiment of FIG. 18 is again a higher simplicity of arrangement of the spinning unit, which comprises in this case a smaller number of positively driven elements. The driving shaft 43 is also provided with a bore 161 for supplying a carrier thread for manufacturing core yarn.

Figure 19:
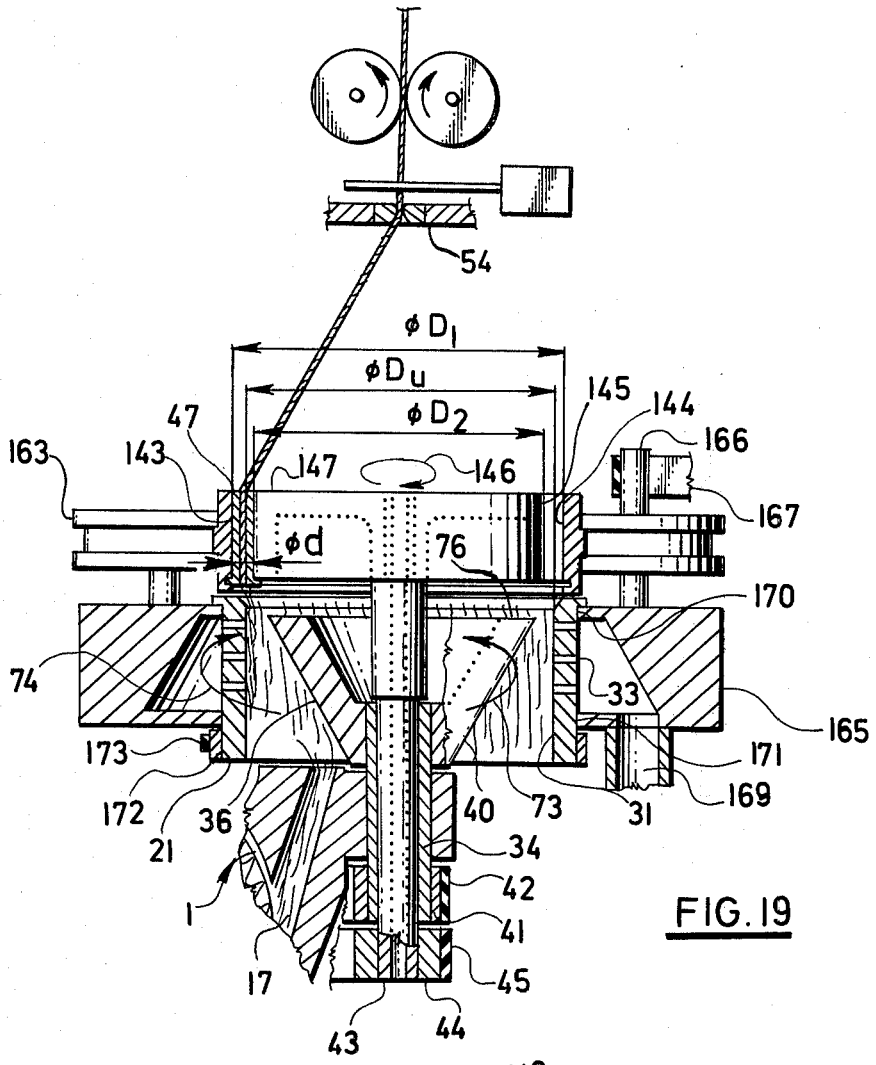

FIG. 19 shows a spinning unit which distinguishes from that illustrated in FIG. 18 in that the drum is mounted for rotation in plain bearings 170, 171 provided in a recess of the annular body 165. The drum 21 carries a pulley 172 driven from the driving means (not shown) via belt 173. The direction of rotation of the drum 21 is indicated by arrow 74. The advantage of this embodiment consists in a higher degree of doubling fibers on the deposit surface 31.

As hereinbefore set forth, the twist ube 143 can roll between the stationary frictional surface 144 and the movable frictional surface 145, the opposite kinematic arrangement of said surfaces also being possible.

As shown in FIG. 1, the thread guide 54 lies on the axis of the drum 21. In case the yarn twisting means 47 is stationary, the thread guide 54 can be situated beyond said axis. Such an arrangement is feasible, by way of example, in the spinning unit shown in FIG. 1 wherein the driving shaft 43 can be made immovable, or in the spinning units shown in FIGS. 13 and 19, provided the peripheral speeds of the two rotary frictional surfaces 144, 145 are identical.

Figure 20:
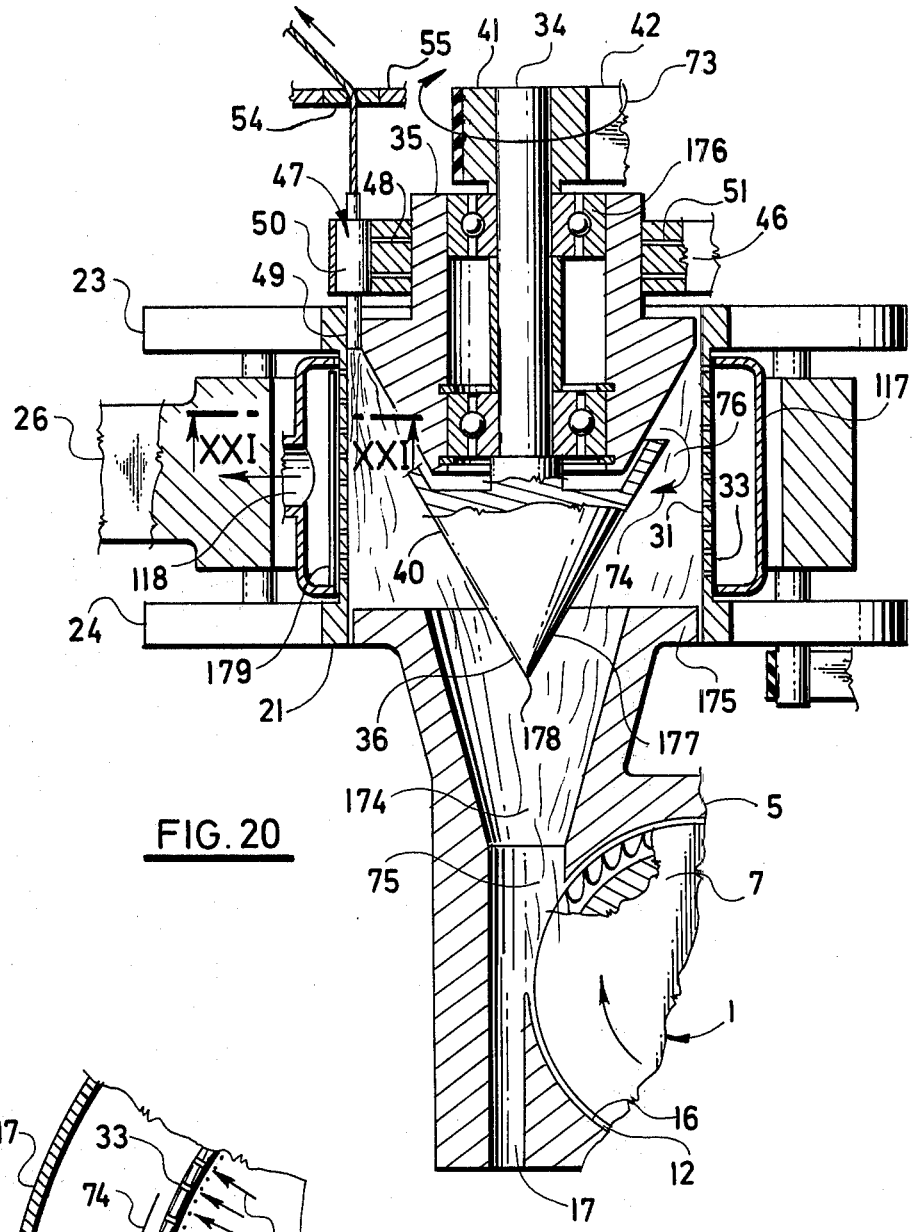
Figure 21:
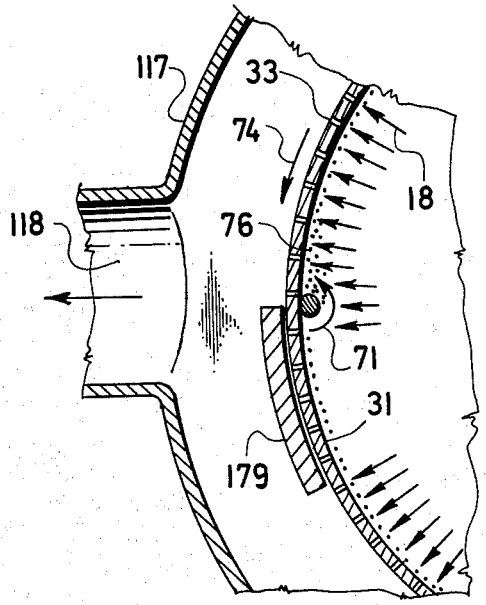
FIG. 21 is a cross-sectional view taken along the line XXI—XXI in FIG. 20.

An exemplary embodiment of the spinning unit with the thread guide 54 disposed of axis of the drum 21 is schematically shown in FIGS. 20 and 21. The fiber separating device 1 is received in the housing 5. The wall 16 of the cavity 12 accommodating the combing cylinder 7 merges into the straight fiber feeding duct 17 which in turn merges coaxially into a conically flared portion 174 which terminates in a flange 175 extending into the cavity of the drum 21 mounted for rotation between pairs of support rolls 23, 24. In the fiber deposit surface 31, ventilation holes 33 are provided. A superatmospheric pressure prevailing in the drum 21 can be raised, for instance, by means of the annular housing 117 surrounding the perforated portion of the drum 21 and communicating via duct 118 with a subatmospheric pressure source (not shown).

In the drum 21 there is coaxially arranged the shaft 34 mounted for rotation in bearings 176 which are provided in the stationary bracket 35 coupled via carrier 46 of the yarn twisting means 47 with the spinning unit frame 26.

The extremity of the shaft 34 extending into the interior of the drum 21 carries the fiber spreading element 36 in the form of a cone 177 the surface of which constitutes the operating surface 40. The base of the cone 177 extends into the region of ventilation holes 33 in the deposit surface 31, and its apex 178 into the flared portion 174 of fiber feeding duct 17. The free end of the shaft 34 carries the pulley 41 driven via driving belt 42.

In the carrier 46 there is provided the drive fluid supply 48 for the twisting means 47 having the take-off tube 49. In this embodiment the twisting means is arranged as the pneumatic yarn twisting chamber 50 into which pressurized air is supplied via duct 51. In an imaginary extension of the take-off tube 49, i.e. outside the drum 21, there is disposed the thread guide 54 supported in the holder 55 secured to the frame (not shown). Downstream of the thread guide 54 the take-off and the winding device (not shown) are arranged. Outside the drum 21, close to but contactless and stationary relative to its surface, there is provided a baffle plate 179 (FIG. 21) which simulates the shape of the cylindrical drum surface and which is connected by not shown means with the annular housing 117. The baffle plate 179 located downstream of the yarn building region, relative to the sense of drum rotation, masks the corresponding ventilation holes 33 so as to eliminate the subatmospheric pressure effect in this region.

In the operation of the embodiment of FIGS. 20 and 21 the flow of discrete fibers 75 advances from the separating device 1 toward the apex 178 of the spreading element 36. Due to the effect of inertia forces excited by the rotation of the combing cylinder 7 and to the air motion, the fibers are dragged over the operating surface 40, and, due to the centrifugal force produced by the rotation of said operating surface 40, they are spread about the entire periphery of the deposit surface 31 and are positionally fixed thereon predominantly by a power effect of the air sucked in through the ventilation holes 33 as indicated by arrows 180. Owing to a slow movement of the fiber deposit surface 31, the centrifugal force component is minimal.

The directions of rotation of the fiber deposit surface 31 (see arrow 74) and that of the operating surface 40 (see arrow 73) are the same in the exemplary embodiment, but they can be also opposite.

On the deposit surface 31, the fibers form the fibrous layer 76 which advances in the direction of arrow 74 to the yarn building region defined by the position of the take-off tube 49 of the yarn twisting means 47. The aforementioned power effect is uniformly distributed about the periphery of the deposit surface 31, except for the section masked by the baffle plate 179, where the fibers are not exposed to the vacuum effect. Since the yarn building region is preferably situated at the beginning of the vacuum free section, it is evident that such an arrangement positively influences the twisting of the fibrous layer 76 to form the yarn 70, in the direction of the arrow 71. Thus the yarn is twisted, on the one hand, by the pneumatic effect on the fibrous layer 76 and, on the other hand, by the operation of the twisting means 47. The section defined by the baffle plate 179 has to be sufficiently long but not too long either. The yarn 70 being twisted by the twisting means 47 is withdrawn via thread guide 54 and wound. The yarn produced in this way is characterized by a relatively high uniformity.

Apart from the twisting means based upon the principle of rolling a twist tube between two coaxial rotary frictional surfaces, it is also possible to employ other means for driving the twist tube such as, for instance, a system of frictional wheels with parallel rotational axes, the tube being located in a wedge-like space between adjacent wheels and its axial position being secured either mechanically or magnetically. Such mechanisms are known in the technology of texturing filament yarns by false twist. Since such twisting means are stationary, it is possible to arrange the thread guide beyond the drum axis, if that is felt to be effective.

It is to be understood that the embodiments as hereinbefore described and illustrated constitute only some examples of all the possible solutions resulting from real combinations of the individual work elements of the spinning unit, based upon various kinematic arrangements of said elements.

Exemplary calculations of the fundamental kinematic parameters of the work elements of spinning unit in the manufacture of 50 tex cotton yarn having a twist coefficient of $\alpha^{\frac{2}{3}}(am)=75$ and withdrawn at the velocity of $v_{odt}==500$ m.min.$^{-1}$, are set forth below.

The yarn is twisted, due to a torque produced, e.g., by the rotation of the twist tube 143 in the spinning unit shown in FIG. 19. The twist tube is rolled between the two frictional surfaces 144, 145.

The yarn will have z twists per one meter length; the quantity z is calculated from the known equation $$z = \alpha^{\frac{2}{3}} \frac{100}{\sqrt[3]{\text{tex}^2}} = 75 \cdot \frac{100}{\sqrt[3]{50^2}} = 552.6 \text{ turns per meter.}$$

At a given yarn take-off speed $v_{odt}$, the speed of revolution $n_k$ of the twist tube can be derived from the equation $$n_k = v_{odt} \cdot z = 500 \cdot 552.6 = 276{,}300 \text{ r.p.m.}$$

The exemplary dimensions of the twist means elements are as follows:

| | |
|---|---|
| external diameter of the twist tube 143 | d = 3mm |
| diameter of the outer frictional surface 144 | $D_1$ = 100mm |
| diameter of the inner frictional surface 145 | $D_2 = D_1 - 2d$ = 94mm |

Let us consider at first the case in which the surfaces rotate in opposite directions and at the same peripheral velocity. Then the speed of revolution of the outer frictional surface 144 ($n_1$) can be calculated from the equation $$n_1 = \frac{n_k}{2} \cdot \frac{d}{D_1} = 138{,}150 \cdot \frac{3}{100} = 4{,}144.5 \text{ r.p.m.}$$

Similarly the speed of revolution of the inner frictional surface 145 results from the equation $$n_2 = \frac{n_k}{2} \cdot \frac{d}{D_2} = 138{,}150 \cdot \frac{3}{94} = 4{,}409.4 \text{ r.p.m.}$$

To rotate the open yarn end it is necessary to supply fibers in the form of a permanently supplemented fibrous layer which is deposited about the entire circumference of the deposit surface 31. The speed of the fibrous layer supply to the open yarn end is given by a relationship between the peripheral velocity of the deposit surface 31 and the speed of revolution of the twist tube 143 about the axis 146 of the drum 21. In the first case, i.e. when the twist tube 143 is rotated between the frictional surface 144, 145 moving at the same speed but in opposite directions, the twist tube 143 is stationary relative to said axis, so that the aforementioned speed ratio is given only by the speed of the deposit surface 31. The last-mentioned speed can be chosen in dependence upon the desired spinning process.

The simplest case occurs when the peripheral speed of the yarn and that of the deposit surface are the same at the point of their interaction. If the yarn diameter—calculated from the known relation—$d_p=0.045\sqrt{\text{tex}}=0.32$ mm and the diameter of the deposit surface 31 $D_u=D-d=97$ mm, then the peripheral speed of the deposit surface 31 has to be given at least by the speed of revolution $n_u$ in accordance with the equation $$n_u = n_k \cdot \frac{d_p}{D_u} = 276{,}300 \cdot \frac{0.32}{97} \; 911.5 \text{ r.p.m.}$$

Let us now take the case wherein the deposit surface rotates at a higher speed than the peripheral velocity of the yarn while moreover the open yarn end slips relative to the deposit surface. The fibrous layer (1) will then necessarily contain a smaller number of fibers than in the case (2) of the same peripheral velocities of the yarn and of the deposit surface. When, for instance, the fibrous layer (1) contains half the amount (2) of fibers, the speed of revolution of the deposit surface $n_u'=2 \cdot 911.5=1823$ r.p.m. Such case can be availed of when yarns with various structural characteristics are to be obtained.

As hereinafter set forth, the fibers are distributed onto the deposit surface 31 by spreading, by means of the element 36 which is supplied with fibers continuously flowing from the separating device. If it is desired that a very uniform fibrous layer 76 be formed of the deposit surface 31, the speed of revolution $n_r$ of the fiber spreading element 36, considering 5 ply fiber doubling on the deposit surface 31 and a given speed of revolution $n_u$ of said surface 31, can be calculated from the equation $$n_r = n_u \cdot 5 = 911.5 \cdot 5 = 4557.5 \text{ r.p.m.;}$$

analogously, at the speed of revolution $n_u'$ of the deposit surface 31, the speed of revolution $n_r'$ of the fiber spreading element 36

$$n_r' = n_u' 19\ 5 = 1823 \cdot 5 = 9115 \text{ r.p.m.}$$

Let use further consider the case wherein the twist tube 143 is rolled between the movable outer frictional surface 144 and the immovable frictional surface 145. In this case the twist tube 143 revolves moreover about the axis 146 of the drum 21.

During one revolution about said axis 146, the twist tube 143 makes $D_2/D_1$ revolutions about its own axis.

In this case the twist tube 143 makes per 94/3 =31.33 revolutions about its own axis, one revolution about the drum axis 146, so that 31.33+1=32.33 twist turns are imparted to the yarn.

To obtain z=276,300 twist turns per minute, the aforementioned cycle has to be repeated 8,546.24 times per minute whereby the yarn is given, due to the revolution of the twist tube 143 about its own axis, 276,300−8,546.24=267,753.76 twist turns, and due to the revolution of said tube 143 about the axis 146 of the drum 21, is given 8,546.24 additional turns so that the total twist number will correspond to that of the first-named case; however, such different twist character will manifest itself in a different internal and external structure of the final yarn product.

The outer rotary frictional surface 144 having the diameter $D_1$ has to revolve at a speed $n_1$=267,753.76·3/100=8,032,61 r.p.m.

The rates of movement of the two frictional surfaces 144, 145 are chosen in dependence upon the particular technological requirements.

Similarly, the above calculations hold even when applying another type of yarn twisting means such as, for instance, one in the form of a twist chamber, the rotor of an electric motor, or the like.

These calculations suggest that the spinning device operates within speed of revolution ranges which, from the technical point of view, are easily feasible. Such ranges prove at the same time an obvious advantage of this spinning system over the rotor open-end spinning systems.

Supposing optimistically the upper limit of the speed of rotation of the spinning rotor to be 90,000 r.p.m., it results that a rotor spinning unit allows the maximum output (yarn takeoff speed)

$$V_{odt} = \frac{90{,}000}{z}\ 162.87 \text{ m per minute}$$

which is 3.07 times less than the output obtainable with the spinning unit of the invention.

Although the invention is illustrated an described with reference to a plurality of preferred embodiments thereof, it is to be expressly understood that it is in no way limited to the disclosure of such a plurality of preferred embodiments, but is capable of numerous modifications within the scope of the appended claims.

We claim:

1. An open-end spinning method, comprising supplying a flow of discrete fibers to a fiber spreading element to spread them over the entire periphery of an inner fiber deposit surface of a drum whereby a fibrous layer is continuously created on the deposit surface, successively withdrawing fibers from such deposited fibrous layer by taking off the open end of yarn, and rotating said open end of yarn about its axis by a twisting moment acting on the yarn and created in a region beyond the drum axis.

2. A method as claimed in claim 1, wherein the yarn being formed is given an additional twist by causing the open yarn end to revolve about the axis of the drum.

3. A method as claimed in claim 1, wherein the fibrous layer follows a circular path, the position of the yarn open end being constant.

4. A method as claimed in claim 1, wherein the open yarn end follows a circular path, the position of the fibrous layer being constant.

5. A method as claimed in claim 1, wherein the fibrous layer follows a circular path, and the open yarn end follows a concentric circular path in a direction opposite to that of the fibrous layer.

6. A method as claimed in claim 1, wherein the fibrous layer follows a circular path, and the open yarn end follows a concentric circular path in the same direction as but at a different peripheral velocity than the fibrous layer.

7. An open-end spinning apparatus, comprising a fiber separating device, a spinning device, and a yarn take-off device, comprising a fiber spreading element, a fiber feeding duct directed toward the operating surface of the fiber separating device, a drum coaxial with said fiber spreading element, the drum being provided with an inner fiber deposit surface for receiving the spread fibers, further yarn twisting means radially disposed relative to the axis of said drum, and a thread guide preceding the yarn take-off device, at least one member of the pair comprising the drum and the yarn twisting means being rotatable about the axis of the drum.

8. An apparatus as claimed in claim 7, wherein the yarn twisting means which is provided with separate driving means and comprising a take-off tube for withdrawing the twisted yarn from the region of maximum diameter of the fiber deposit surface.

9. An apparatus as claimed in claim 7, wherein the yarn twisting means is provided on a carrier disposed radially on a driving shaft coaxial with the drum, the direction of rotation of said shaft corresponding to the direction of torque of the yarn twisting means.

10. An apparatus as claimed in claim 7, wherein the yarn twisting means is provided on the carrier rotatable on a stationary guide tube coaxial with the drum and located between said drum and the yarn take-off device, the mouth of said tube being formed by a thread guide.

11. An apparatus as claimed in claim 9, wherein in the driving shaft and in the carrier there is provided a drive fluid supply for the yarn twisting means.

12. An apparatus as claimed in claim 7, wherein the yarn twisting means is a pneumatic yarn twisting chamber.

13. An apparatus as claimed in claim 7, wherein the yarn twisting means is the rotor of a rotary electric motor.

14. An apparatus as claimed in claim 7, wherein the yarn twisting means is the rotor of a rotary pneumatic motor.

15. An apparatus as claimed in claim 7, wherein the fiber deposit surface is conically flared from the inlet portion of the drum.

16. An apparatus as claimed in claim 15, wherein the fiber deposit surface is provided with ventilation holes.

17. An apparatus as claimed in claim 7, wherein the fiber deposit surface of the drum is formed as a peripheral groove having ventilation holes, such groove merging in the direction toward the thread guide in the form of a conically narrowing surface into a cylindrical surface associated in the contactless manner with the yarn take-off tube, and in the direction toward the fiber spreading element merging into a flared sliding surface followed by the operating surface of said spreading element, said surface being provided on an inner conical surface of said fiber spreading element.

18. An apparatus as claimed in claim 7, wherein the yarn twisting means is a twist tube adapted for rolling between an inner frictional surface and an outer frictional surface of rotation, said two frictional surfaces being concentric with the axis of the drum, at least one of said two frictional surfaces being rotatable.

19. An apparatus as claimed in claim 18, wherein the outer frictional surface is provided on the inner wall of the drum and the inner frictional surface is provided on a wheel rotatable in the drum.

20. An apparatus as claimed in claim 18, wherein the outer frictional surface is provided on the inner wall of a rotatable ring.

21. An apparatus as claimed in claim 18, wherein the twist tube between the frictional surfaces is prevented from axial displacement by a flange guided in a peripheral groove provided in the outer frictional surface.

22. An apparatus as claimed in claim 9, wherein the carrier carries additional yarn twisting means disposed opposite and symmetrically relative to said first twisting means.

23. An apparatus as claimed in claim 18, wherein between the two frictional surfaces there is provided an additional twist tube opposite the first twist tube.

* * * * *